US005445787A

United States Patent [19]

Friedman et al.

[11] Patent Number: 5,445,787

[45] Date of Patent: Aug. 29, 1995

[54] METHOD OF EXTRUDING REFRACTORY METALS AND ALLOYS AND AN EXTRUDED PRODUCT MADE THEREBY

[76] Inventors: Ira Friedman, 10 Bingham Hill Cir., Rumson, N.J. 07760; Christer Aslund, Bravallavagen 11 644 36, Torshalla, Sweden

[21] Appl. No.: 146,788

[22] Filed: Nov. 2, 1993

[51] Int. Cl.[6] ..... B22F 3/16

[52] U.S. Cl. ..... 419/38; 419/5; 419/6; 419/26; 419/28; 419/39; 419/42; 419/53; 419/55

[58] Field of Search ..... 419/5, 6, 26, 28, 38, 419/39, 42, 53, 55; 75/229; 428/558; 361/307, 433

[56] References Cited

U.S. PATENT DOCUMENTS

| | | | |
|---|---|---|---|
| 4,143,208 | 3/1979 | Aslund | 428/558 |
| 4,150,196 | 4/1979 | Aslund | 428/558 |
| 4,364,162 | 12/1982 | Nilsson et al. | 419/26 |
| 4,647,197 | 2/1987 | Wong | 361/307 |
| 4,710,345 | 12/1987 | Doi et al. | 419/28 |
| 4,729,789 | 3/1988 | Ide et al. | 75/244 |
| 4,734,827 | 3/1988 | Wong | 361/433 |
| 5,080,712 | 1/1992 | James et al. | 75/229 |

*Primary Examiner*—Donald P. Walsh
*Assistant Examiner*—John N. Greaves
*Attorney, Agent, or Firm*—McAulay Fisher Nissen Goldberg & Kiel

[57] ABSTRACT

The process of forming an extruded product of tantalum or niobium requires a cold isostatic pressing of a charge of the powder to a density sufficient to form a green compact which is then placed in a capsule. The capsule is then sealed and heated to a temperature and for a time sufficient to anneal the green compact. Thereafter, the capsule and encapsulated compact are subjected to a cold isostatic pressing to achieve a density of from 70% to 85%. This is followed by subsequent heating and extrusion of the heated capsule and encapsulated compact to form the extruded product. The outer layer on the capsule which has been formed by the capsule material can be removed, as by pickling, in the case of the capsule being a carbon steel.

18 Claims, 1 Drawing Sheet

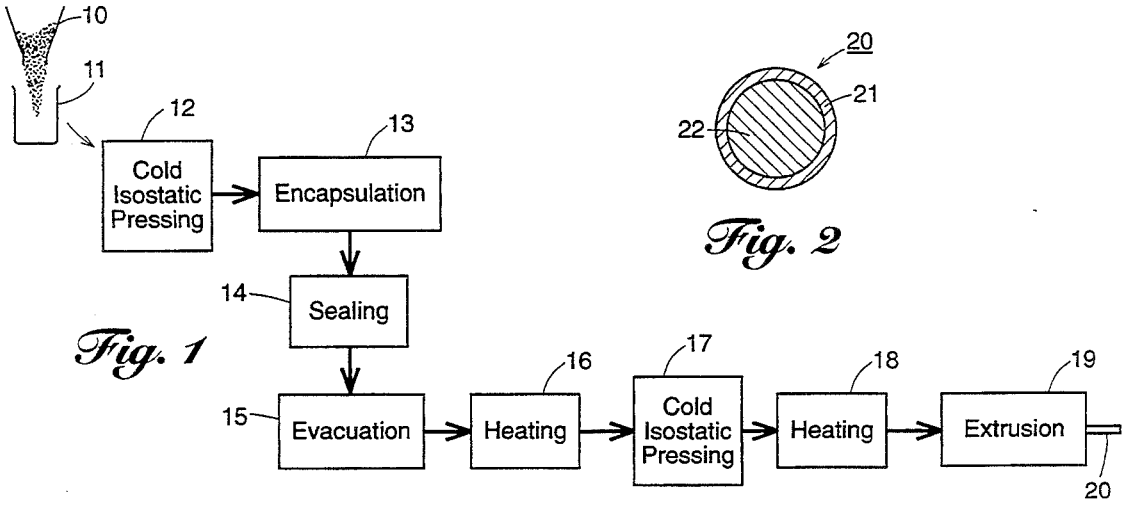
Fig. 1
Fig. 2
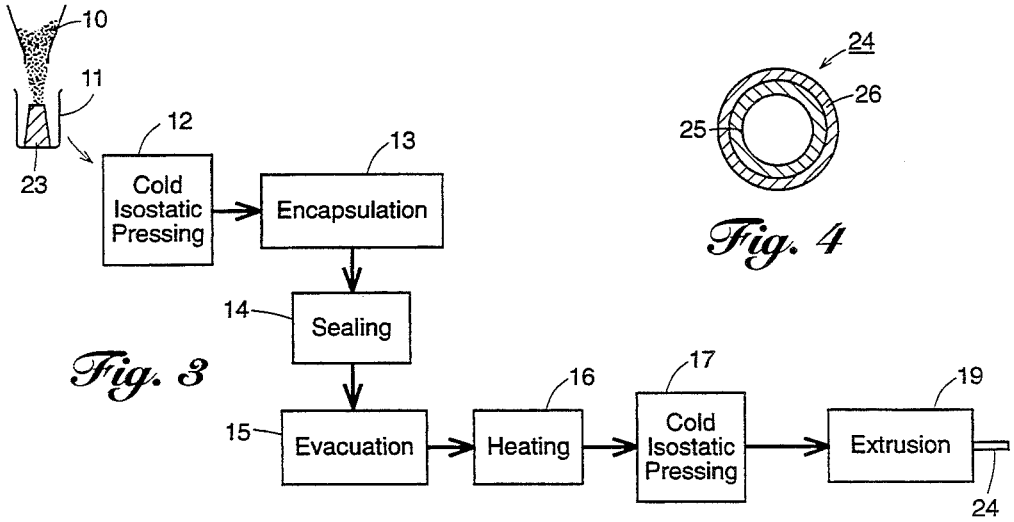
Fig. 3
Fig. 4
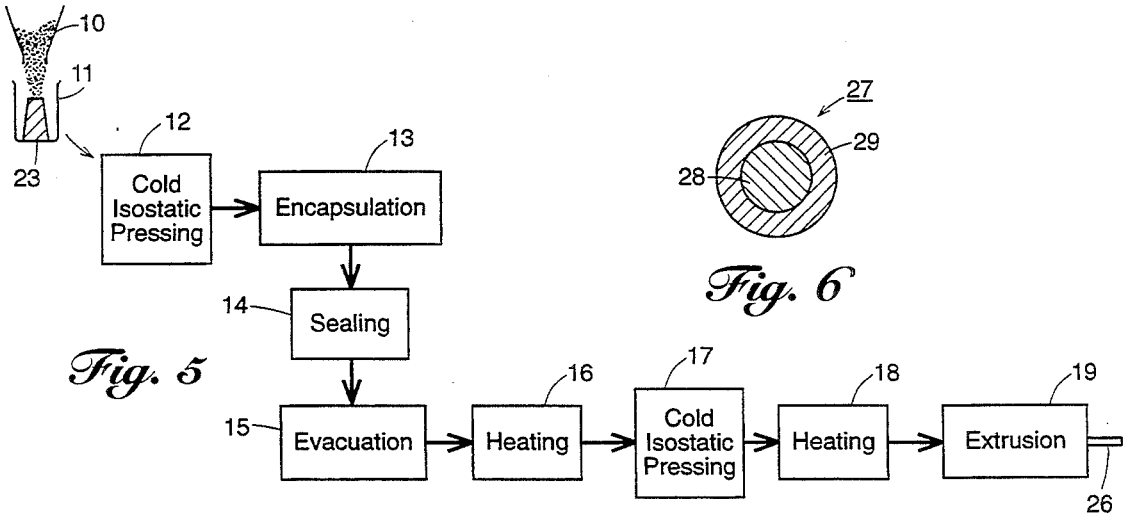
Fig. 5
Fig. 6

METHOD OF EXTRUDING REFRACTORY METALS AND ALLOYS AND AN EXTRUDED PRODUCT MADE THEREBY

This invention relates to a method for extruding refractory metals and alloys and to an extruded product made thereby.

As is known, refractory metals such as tantalum and niobium are important metals due to their high melting temperatures, good corrosion properties and special electrical properties. In the pure state, tantalum and niobium are very ductile but are sensitive to even small levels of interstitial impurities such as oxygen, nitrogen and carbon. Due to this factor and the extremely high melting temperatures of these metals, for example, tantalum melts at 3000° C., the production of tantalum wrought products has been very costly due to the need to have many production steps, intermediate annealing steps and yield losses.

As is also known, one technique for producing mill products such as rod, sheet and tubing of iron, nickel and cobalt-based alloys is to extrude the metal from powder. For example, as described in U.S. Pat. No. 4,050,143 one known process known as the Anval process uses a metal powder wherein the powder has spherical grains. In addition, the spherical powder is introduced into a thin carbon steel capsule and cold isostatically pressed to a density of over 80 percent and subsequently extruded into tubes, bars and other shapes. The pressing of the powder to a density over 80% is required in order to avoid wrinkling, of the capsule during the extrusion step.

Other processes use hot pressed blanks, for example, using hot isostatic pressing followed by extrusion.

U.S. Pat. No. 4,599,214 describes a method of extruding dispersion strengthened metallic materials in which a billet of dispersion strengthened metallic powdered material comprised of one or more metals and one or more refractory compounds is extruded through a die having an internal contour such that the material is subjected to a natural strain rate which is substantially constant as the material passes through the die. As described, the dispersion strengthened materials are those wherein a hard phase is present with one or more metals. The preferred materials are described as being alloys containing two or more metals.

European Patent 0 305 766 describes a method of making a reinforced refractory metal composite which employs niobium powders. In one embodiment, a particulate dispersoid and a matrix material are mixed together. Thereafter, the mixture is mechanically alloyed and cold pressed to reduce the volume of the composition and to form a low density green compact of 50% to 70% of theoretical density. Next, the green compact is enclosed in a can which is evacuated and then heated to temperatures in excess of 1000° C. and pressures in excess of 680 atmospheres to be hot isostatically pressed to a density greater than 90%. After consolidation, the densified compact is extruded through a die to form a required shape. In another embodiment, short fibers are added to the matrix to strengthen the composite. U.S. Pat. No. 4,646,197 describes a method for making a tantalum capacitor lead wire. As described, the product is formed by wrapping a tantalum foil around a metal billet which may be made of niobium to provide at least one layer of tantalum around tile billet. The compacted body is then inserted into an extrusion billet and the resulting composite extruded and further reduced by rolling and/or drawing to a wire of the requisite size.

As is known, refractory metals such as tantalum and niobium can be produced efficiently by mechanical or chemical means. However, these production means provide an irregularly shaped powder. Generally, the irregularly shaped powder can be characterized as being of very low filling density, normally between 40% to 50%, with poor flowability.

Accordingly, when using such irregularly shaped powder in canned billets which are subsequently extruded, the low filling density of the powder causes the billet to collapse causing wrinkling and distortion in the extruded product. Further, even if such a billet were to be cold isostatically pressed, the low initial density does not permit the final density to exceed approximately 60%. This, in turn, also causes problems in extrusion especially when extruding tubes or shapes. When hot isostatic pressing is performed, the flow density causes wrinkling and often makes machining necessary before extrusion.

In the past, it has been difficult to obtain products made of tantalum and niobium with a high density at a low cost.

Accordingly, it is an object of the invention to be able to produce products made of tantalum and/or niobium at a relatively low cost and with a high density.

It is another object of the invention to provide a relatively simple technique for extruding tantalum and niobium powders into extruded products of high density.

It is another object of the invention to provide an improved method of forming high density tantalum and niobium products.

Briefly, the invention provides a process of forming extruded products of tantalum and/or niobium.

In accordance with the process, a charge of powdered metal selected from the group consisting of tantalum and niobium and having a density in the range of 40% is placed in a container and cold isostatically pressed at a predetermined pressure to a density sufficient to form a green compact with a sufficient strength to be handled outside the container. In accordance with the process, the charge of powdered metal is pressed at a pressure of 400 Mpa. However, a range of from 200 to 500 Mpa may be used.

Of note, the term "density" used herein is the theoretical density of the metal.

Thereafter, the green compact is placed in a capsule, for example, of carbon steel. The capsule is then sealed and then preferably evacuated to remove air or any gases within the compact.

Next, the capsule is heated to a predetermined temperature for a time sufficient to anneal the metal of the compact thereby reducing the hardness of the metal. Further, the capsule is heated at a temperature of 1250° C. for 30 minutes. However, the capsule may be heated to a range of from 1150° C. to 1400° C. for a time of from 10 to 30 minutes.

Thereafter, the capsule and encapsulated compact are cold isostatically pressed at a pressure which, at the minimum is 200 Mpa,to a density of from 70% to 85%. The pressed capsule and capsulated compact is then heated and extruded to form an extruded product, for example, in the form of a rod.

The isostatic pressing of the capsule and encapsulated compact is carried out at a pressure of 400 Mpa. However, the pressure used may be in the range of from 200 to 500 Mpa. Likewise, the heating of the capsule and encapsulated compact is carried out at a temperature of 1200° C. However, the temperature may be in the range of from 1150° C. to 1400° C.

The extruded product may be of any suitable shape such as a bar shape, rod shape, tube shape or the like.

After extrusion, the layer of carbon steel existing on the outside surface of the extruded product is removed, for example, by pickling. In the event a capsule of another material is used, other techniques may be employed to remove the layer of the material from the extruded product.

The extruded product may also be made in the form of a hollow tube. In this respect, a green compact of the powdered material can be formed around a solid mandrel which is subsequently removed with the green compact then being placed within a hollow billet which is subsequently sealed, evacuated, heated and cold, isostatically pressed to a density of at least 80%. Thereafter, the pressed billet can be heated and extruded to form an extruded hollow tube.

The extruded product may also be made to have a layer of different material on the outside, or on the inside surface where the extruded product is hollow. In this embodiment, when the green compact is placed in a metal capsule, a gap existing between the outside of the green compact and the inside of the capsule can be filled with a spherical powder of suitable material, for example, Inconel 625 which is a corrosion resistant nickel-based alloy which can be gas atomized to a spherical shape. For example, the filling density of the nickel-alloy may approximate 65% which is near the density of the compact. The capsule with the two materials therein can then be sealed, evacuated, and heated, as above, at 1250° C. for 30 minutes. After the heating (annealing) treatment, the capsule is cold isostatically pressed as above.

These and other objects and advantages of the invention will become more apparent from the following detailed description taken in conjunction with the accompanying drawings wherein:

FIG. 1 schematically illustrates the steps in a process in accordance with the invention;

FIG. 2 illustrates a cross-sectional view of an extruded product in accordance with the process of FIG. 1;

FIG. 3 schematically illustrates the steps of a process for producing an extruded tube in accordance with the invention;

FIG. 4 illustrates a cross-sectional view of an extruded tube produced by the process in FIG. 3;

FIG. 5 schematically illustrates the steps of a further modified process in accordance with the invention for producing a multi-layer extruded product; and FIG. 6 illustrates a cross-sectional view of a multi-layer extruded product made in accordance with the process of FIG. 5.

Referring to FIGS. 1 and 2, the process of forming an extruded product of a powdered metal material selected from the group consisting of tantalum, niobium and titanium is initiated with the placement of a charge 10 of the powdered metal having a density in the range of 40% in a container 11. The charge in the container is then placed in a cold isostatic press and subjected to a step 12 of cold isostatic pressing at a predetermined pressure to a density sufficient to form a green compact with sufficient strength to be handled outside the container.

Cold isostatic presses are well-known constructions typically used to compact metal powders, ceramics and graphite, usually to produce a green body for further sintering and the like. One known supplier of such presses is ABB Metallurgy and, in the United States, ABB Autoclave. The capacity of such presses are determined by the volume of a pressure chamber which is filled with water. The water is thereafter pressurized and acts directly as a pressure medium on the capsule, Several capsules can be pressed at the same time. Further, the sizes of the presses can range in terms of diameter and length of from 2 inches by 4 inches up to 60 inches by 120 inches.

The irregularly shaped powder of tantalum or niobium or titanium can be cold pressed and has enough green strength so as to be handled after pressing. One method of cold pressing such powders is to use cold isostatic pressing in a rubber bag (the so-called wet bag process). The compacted powder can thereafter be released from the rubber bag and handled for subsequent steps. Generally, the density of the compact which is achieved at pressures of from 300 to 800 Mpa is approximately 60%. Higher densities cannot usually be obtained as the work hardening of the powder prevents the powder from achieving a density of a higher degree. Heating such compacts at temperatures over 1200° C. reduces the hardness and thereby allows the possibility of further cold pressing.

In one test, irregular tantalum powder was filled in a container 11 in the form of a rubber bag with a length of 550 millimeters and a diameter of 165 millimeters. The filling density was approximately 46%. The bag was then cold isostatically pressed in the press 12 at 400 Mpa to a density of 62%. After releasing the .pressure, the green compact was removed from the rubber bag and was measured to have a length of 500 millimeters and a diameter of 150 millimeters.

The green compact was then encapsulated 13 by being placed in a low carbon steel capsule with a gap of 1 millimeter between the compact and the capsule in order to be able to introduce the compact into the capsule. The capsule was then sealed by welding end closures at the ends and evacuated in suitable steps of sealing 14 and evacuation 15. Thereafter, the capsule was subjected to a heating step 16 in a suitable heater or oven to a temperature of 1250° C. in a salt bath to avoid heavy oxidation of the capsule for a time of 30 minutes.

Subsequently, the capsule with the compact was subjected to a cold isostatic pressing step 17 in the same cold press and pressed at 400 Mpa to a density of 80%. The resulting billet had a length of 460 millimeters and a diameter of 138 millimeters.

The billet was thereafter subjected to a heating step 18 again to 1250° C. and subsequently subjected to a step of extrusion 19 in a suitable extruder and extruded to a bar 20 of 40 millimeters diameter. This extruded bar 20 was then pickled to remove the thin capsule layer 21 from the core 22. The resulting extruded bar 22 showed a smooth and regular surface with no marks or indentations.

Both steps of heating 16, 18 before and after the second cold isostatic pressing step 17 can be performed in several ways. One way is to preheat in a gas furnace for a time of one hour to 700° C. and to subsequently heat in a salt bath for 30 minutes up to 1250° C. (to avoid oxidation). Other heating techniques such as direct heating in a protective gas atmosphere or vacuum may also be used.

In another test, the same type of tantalum powder was filled directly in the same carbon steel capsule as above with the same filling density of 46%. The capsule with the powder was then cold isostatically pressed to a density of 60% heated and extruded to the same diameter bar. After removal of the extruded layer of carbon steel, the extruded bar showed an imperfect surface due to wrinkling and indentations caused by the low initial density. In this respect, when using such powders in can billets which are subsequently extruded, the low filling density causes the can to collapse thereby causing wrinkling and distortion. Even if such a billet were cold isostatically pressed, the low initial density does not permit the final density after cold isostatic pressing to exceed approximately 60%, This, in turn, also causes problems in extrusion especially when extruding tubes or shapes. When hot isostatic pressing is carried out, the low density causes wrinkling and often makes machining necessary before extrusion.

Referring to FIGS. 3 and 4, wherein like reference characters indicated like parts as above, in a third test, a rubber bag with a diameter of 100 millimeters and a length of 550 millimeters was charged with powdered tantalum as above, with the powdered metal being placed about a tapered mandrel 23 with a diameter of 60 millimeters in the bag. After cold isostatic pressing 12, as above, the tapered mandrel 23 was removed and the hollow compact encapsulated 13 in a hollow billet having an outer wall with an external diameter of 150 millimeters and an inner wall with an outer diameter of 58 millimeters. The gap between the outside diameter of the compact and the inside diameter of the billet was then filled with a spherical powder of quality Inconel 625 with the filling density of this nickel-alloy being approximately 65%, that is, at a density near the density of the compact. The resultant compound capsule was then sealed, evacuated and annealed, as above, at 1250° C. for 30 minutes.

After the annealing treatment 16, the capsule was cold isostatically pressed 17 at 400 Mpa and subsequently heated and extruded 19 to a compound tube 24 with an outside diameter of 65 millimeters and an inside diameter of 50 millimeters. The bond between the two layers of metal was excellent and the thickness of the two layers was homogeneous along the length of the tube. In this respect, as indicated in FIG. 4, the extruded tube 24 formed an internal layer 25 of pure tantalum and an outer layer 26 of nickel alloy.

In another trial, the two metals, as above, were directly filled in a capsule, cold isostatically pressed, heated and extruded to the same two dimensions. Due to the low filling density of the tantalum powder, and the difference relative to the nickel alloy, the extruded tube showed very large variations in wall thickness and many imperfections.

Referring to FIGS. 5 and 6, wherein like reference characters indicate like parts as above, an extruded product 27 of multi-layered construction may be formed in a manner similar to the product of FIGS. 3 and 4. That is, the extruded product 27 may have a solid core 28 of tantalum and/or niobium surrounded by an outer layer 29 of another material.

In the embodiment where a hollow extruded product is to be made, the hollow green compact as formed above, is placed in a hollow billet or capsule without the introduction of the added powdered material of another metal. In this case, after extrusion and removal of the billet material, as by pickling, the resultant hollow extruded product is made solely of tantalum and/or niobium.

The evacuation of the green compact within the capsule can be accomplished by using a vacuum or by backfilling with a suitable gas after evacuation.

The extrusion of the billet may be carried out so that the extrusion ratio exceeds five (5) times. Generally, where a compounded (multilayered) extruded product is to be produced, a spherical powder is used for the second alloy which is to be filled into the capsule after the cold pressed compact has been placed in the capsule, Further, the spherical powder may be made of any suitable alloy such as a gas atomized powder of iron - nickel- or cobalt base alloys.

The tantalum or niobium powder which is used in the process is usually less than −12 mesh size with the preferred range being from minus −12 to +100 mesh size. Therefore, the metal powder is made of particles which are of coarse size rather than being of finer or smaller size so that there is less chance of picking up nitrogen, oxygen or the like, This in turn, reduces the risk of explosion which exists should very fine particles be used.

Generally, the gas content of the original powder should be under 300 PPM of oxygen with a preferred range of less than 200 PPM.

The invention thus provides a process of achieving extruded products of pure tantalum or niobium in a relatively simple inexpensive manner, Further, the invention provides a process which is able to use coarse powdered metal particles thereby reducing the risk of explosions and of incorporating unwanted gases in the intermediate products and final product made from the powdered metal.

What is claimed:

1. A process comprising the steps of placing a charge of powdered metal having a density in the range of 40 percent in a container, said metal being selected from the group consisting of tantalum or niobium;

cold isostatically pressing the charge at a predetermined pressure to a density sufficient to form a green compact with sufficient strength to be handled outside the container;

placing the green compact in a metal capsule;

thereafter sealing the capsule;

heating the capsule to a predetermined temperature and for a time sufficient to effect annealing of the green compact;

thereafter cold isostatically pressing the capsule and encapsulated compact at a predetermined pressure of at least 200 Mpa.

thereafter heating the pressed capsule and encapsulated compact; and extruding the heated capsule and encapsulated compact to form an extruded product.

2. A process as set forth in claim 1 wherein the charge of powdered metal is pressed at a pressure of 400 Mpa.

3. A process as set forth in claim 1 wherein the capsule is heated to a temperature of 1250° C. for 30 minutes to effect said annealing.

4. A process as set forth in claim 1 wherein the capsule and encapsulated compact are pressed at a pressure of 400 Mpa.

5. A process as set forth in claim 1 wherein the encapsulated compact is pressed at a pressure sufficient to achieve a density of from 70% to 85%.

6. A process as set forth in claim 4 wherein the pressed capsule and encapsulated compact are heated to a temperature of 1200° C.

7. A process as set forth in claim 1 wherein the extruded product is of bar shape.

8. A process as set forth in claim 1 wherein the extruded product has an outer layer of metal different from the remainder of the product and which further comprises the step of removing said outer layer.

9. A process as set forth in claim 8 wherein the capsule is made of carbon steel and said step of removing said layer of carbon steel from the extruded product includes pickling of the extruded product to remove said carbon steel layer.

10. A process as set forth in claim 9 which further includes the step of evacuating the capsule after sealing thereof.

11. A process as set forth in claim 1 which further comprises the step of placing spherical particles of a powdered metal about said green compact in said capsule prior to sealing of said capsule to effect extrusion of a multilayer extruded product having a layer of said metal about a core of tantalum, or niobium.

12. A process comprising the steps of placing a charge of powdered metal having a density in the range of 40% about a tapered mandrel in a container, said metal being selected from the group consisting of tantalum, or niobium;

cold isostatically pressing the charge at a predetermined pressure to a density sufficient to form a hollow green compact with sufficient strength to be handled outside the container;

placing the hollow green compact in a tubular metal capsule having an outer wall and an inner wall;

thereafter sealing the capsule;

heating the capsule to a predetermined temperature and for a time sufficient to effect annealing of the green compact;

thereafter cold isostatically pressing the capsule and encapsulated compact at a predetermined pressure of at least 200 Mpa;

thereafter heating the pressed capsule and encapsulated compact; and extruding the heated capsule and encapsulated compact to form a hollow extruded product.

13. A process as set forth in claim 12 wherein the charge of powdered metal is pressed at a pressure of 400 Mpa.

14. A process as set forth in claim 12 wherein the capsule is heated to a temperature of 1250° C. for 30 minutes to effect said annealing.

15. A process as set forth in claim 12 wherein the capsule and encapsulated compact are pressed at a pressure of 400 Mpa and heated to a temperature of 1200° C.

16. A process as set forth in claim 12 which further comprises the step of placing spherical particles of powdered metal about said green compact in said capsule prior to sealing of said capsule to effect extrusion of a multilayer extruded product having a layer of said metal about a core of tantalum or niobium 17. An extruded product made in accordance with the process of claim 1.

18. An hollow extruded product made in accordance with the process of claim 12.

* * * * *